US012103656B2

(12) United States Patent
Bång et al.

(10) Patent No.: US 12,103,656 B2
(45) Date of Patent: Oct. 1, 2024

(54) SELF-ADJUSTING VARIABLE PITCH PROPELLER

(71) Applicant: SUBMERSED TECHNOLOGIES PP1 AB, Bromma (SE)

(72) Inventors: Emil Bång, Bromma (SE); John Änggård, Skutskär (SE); Mathias Andersson, Obbola (SE)

(73) Assignee: SUBMERSED TECHNOLOGIES PP1 AB, Bromma (SE)

( * ) Notice: Subject to any disclaimer, the term of this patent is extended or adjusted under 35 U.S.C. 154(b) by 0 days.

(21) Appl. No.: 18/573,911

(22) PCT Filed: Jun. 28, 2022

(86) PCT No.: PCT/EP2022/067711
§ 371 (c)(1),
(2) Date: Dec. 22, 2023

(87) PCT Pub. No.: WO2023/275040
PCT Pub. Date: Jan. 5, 2023

(65) Prior Publication Data

US 2024/0262477 A1 Aug. 8, 2024

(30) Foreign Application Priority Data

Jun. 29, 2021 (EP) ..... 21182266

(51) Int. Cl.
*B63H 3/00* (2006.01)

(52) U.S. Cl.
CPC ..... *B63H 3/008* (2013.01)

(58) Field of Classification Search
None
See application file for complete search history.

(56) References Cited

U.S. PATENT DOCUMENTS 2,246,539 A 6/1941 Ruths et al.
2,682,926 A * 7/1964 Evans ..... B63H 3/008 416/89

(Continued)

OTHER PUBLICATIONS

Extended European Search Report dated Dec. 21, 2021 for EP Application No. 21182266.3, 8 pages.

(Continued)

*Primary Examiner* — Juan G Flores
(74) *Attorney, Agent, or Firm* — RMCK Law Group, PLC

(57) ABSTRACT

A self-adjusting variable pitch propeller included a central hub with an axial propeller centre line defining the rotational axis of the propeller. A plurality of blades extend radially from the hub. The hub exhibits a central bore arranged to receive a rotating drive shaft. Each blade is pivotally fixed to the hub and pivotal about a respective blade pivot axis which extends radially from the hub through the respective blade. Each blade exhibits a leading edge, a trailing edge, a pressure side exhibiting a pressure side area and a suction side exhibiting a suction side area. The blades are mechanically interconnected to freely transfer pivotal movement of each blade to all other blades. The pivotal axis of each blade is positioned such that >50% of the suction side area and of the pressure side area is arranged between the trailing edge and the pivotal axis of the respective blade.

16 Claims, 8 Drawing Sheets

(56) References Cited

U.S. PATENT DOCUMENTS

| | | | | | |
|---|---|---|---|---|---|
| 3,308,889 | A * | 3/1967 | Langhjelm | B63H 3/008 | 416/140 |
| 4,140,434 | A * | 2/1979 | Bianchi | B63H 3/02 | 416/212 R |
| 4,304,524 | A | 12/1981 | Coxon | | |
| 5,290,147 | A * | 3/1994 | Karls | B63H 3/008 | 416/34 |
| 5,326,223 | A * | 7/1994 | Speer | B63H 3/04 | 416/89 |
| 5,466,177 | A * | 11/1995 | Aihara | B63H 3/008 | 440/49 |
| 5,549,455 | A * | 8/1996 | Speer | B63H 20/245 | 416/140 |
| 5,851,131 | A | 12/1998 | Bergeron | | |
| 8,449,256 | B2 * | 5/2013 | Bianchi | B63H 3/008 | 416/50 |
| 2010/0040469 | A1 * | 2/2010 | Bianchi | B63H 3/02 | 416/134 R |

OTHER PUBLICATIONS

PCT International Preliminary Report on Patentability dated May 23, 2023 for International Application No. PCT/ EP2022/067711, 6 pages.

PCT International Search Report and Written Opinion dated Sep. 19, 2022 for International Application No. PCT/ EP2022/067711, 11 pages.

* cited by examiner

SELF-ADJUSTING VARIABLE PITCH PROPELLER

CROSS-REFERENCE TO RELATED APPLICATIONS

This application is a 371 U.S. National Stage of International Application No. PCT/EP2022/067711, filed Jun. 28, 2022, which claims priority to European Patent Application No. 21182266.3, filed Jun. 29, 2021. The disclosures of each of the above applications are incorporated herein by reference in their entirety.

TECHNICAL FIELD

The present disclosure relates to the field of marine propellers and in particular to such propellers having a variable and self-adjusted pitch. The propeller may find use for the propulsion of vessels having inboard or outboard power plants, such as engines or motors.

BACKGROUND

Traditional marine propellers for the propulsion of vessels normally have a fixed pitch. A drawback at such fixed pitch propellers is that the chosen pitch can be optimal only for a limited rpm and speed. For optimal usage of the supplied power, the pitch should be low at start and low speed propulsion, whereas it should increase during acceleration to a high pitch at top speeds. The use of fixed pitch propellers therefor necessarily leads to a compromise in regard of acceleration, top speed and energy consumption.

It has therefore been suggested to provide marine propellers with variable pitch. According to one general design line, the pitch may be actively controlled in response to momentarily prevailing circumstances such as speed, rpm, load, supplied power, etc. Such actively controlled variable pitch propellers however need to be comparatively complex in construction and require intricate means for altering the pitch as well as means for determining the prevailing circumstances and systems for actuating the pitch altering means in response to the determined circumstances.

According to another general design line, it has been suggested to provide propellers having automatically self-adjusted pitch. U.S. Pat. No. 3,308,889 discloses such a variable pitch propeller with automatic adjustment. The propeller disclosed in this document comprises a hub and a plurality of blades which are journaled on the hub on axes, each in a plane radial to the hub to permit rotation of each blade to vary its pitch angle. The known propeller further comprises resilient means for applying a biasing torque to the blades urging them in a direction toward the greatest pitch angle. The resilient means are responsive to the fluid pressure load on the blades and comprises a first and a second cam which are movable relative to each other and urged against each other by a spring unit.

U.S. Pat. No. 4,304,524 discloses another variable pitch propeller comprising helicoidal blades mounted on a hub to freely pivot about a radial axis. The pivot axis of each blade is positioned behind the blade, with respect to the direction of the axial movement of the propeller through the water and in front of the blade's centre of mass in the rotational direction of the propeller and arranged such that, when the propeller is rotated in the absence of hydrodynamic forces, centrifugal effects cause the blade to adopt a pitch substantially equal to the pitch of the helicoid. Such an arrangement of the pivotal axis in combination with various requirements on the blade rake, a certain skew-back shape, the pitch ratio and the aspect ratio is said to cause the centrifugal forces and the hydrodynamic forces to act in combination to cause the blade to adopt a position which produces a substantially optimum thrust over a range of rotational and axial speeds.

U.S. Pat. No. 2,246,539 discloses a further variable pitch propeller. This propeller comprise a hub and a number of blades mounted to the hub such that they may pivot about respective radial axes. The blades are mechanically connected to a torsional shaft which, upon rotation of the blades in a first direction, stores the energy to thereby rotated the blades in the opposite at a decrease of the exerted trust.

SUMMARY

An object of the present invention is to provide an enhanced self-adjusting variable pitch propeller for marine use.

Another object is to provide such a propeller which, at use, provides enhanced performance with regard to i.a. faster acceleration, higher top speed, lower energy consumption, reduced slip and increased maneuverability.

A further object is to provide such a propeller which is reliable in use and allows for a comparatively long service life.

Yet another object is to provide such a propeller which facilitates service and repair.

Still a further object is to provide such a propeller which is comparatively simple in construction and which comprises a comparatively low number of constituent components.

Yet an object is to provide such a propeller which may be manufactured at a comparatively low cost.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

The term "pitch" is used to describe the linear distance that the propeller would move in one complete revolution through a solid medium not allowing for slip.

According to a first aspect, the present disclosure provides a self-adjusting variable pitch propeller for marine use as defined by the appended claim 1. The propeller comprises a central hub with an axial propeller centre line defining the rotational axis of the propeller and a plurality of blades extending radially from the hub. The hub exhibits a central bore arranged to receive a rotating drive shaft. Each blade is pivotally fixed to the hub and pivotal about a respective blade pivot axis which extends radially from the hub through the respective blade. Each blade exhibits a leading edge, a trailing edge, a pressure side exhibiting a pressure side area and a suction side exhibiting a suction side area. The blades are mechanically inter-connected to freely transfer pivotal movement of each blade to all other blades. The pivotal axis of each blade is positioned such that >50% of the suction side area and of the pressure side area is arranged between the trailing edge and the pivotal axis of the respective blade.

The term "to freely transfer pivotal movement" should be understood to signify that the blades are mechanically inter-connected without any energy storing means, resilient means or biasing means striving to rotate the blades in a certain direction or towards a certain rotational position. The blades are thus directly interconnected such that rotation of one blade is transferred directly to each other blade and such that it is purely the hydrodynamical forces and possibly the centrifugal effects caused by the rotation of the propeller and acting on the blades which cause the blades to momentarily adapt the self-adjusted angular positions effecting a corresponding pitch.

At self-adjusting variable pitch propellers, the hydrodynamic forces acting on the pressure and suction sides of the blades strive to pivot each blade in opposite directions. The forces acting on the suction side strive to increase the pitch whereas forces acting on the pressure side strive to decrease the pitch. The acting forces varies greatly with varying rpm and the propeller's axial speed through the water. In addition, the three-dimensional geometry of the blades, such as the curvature and the distribution of the blade area along the radial distance from the propeller's rotational axis greatly influence the balance between the forces striving to increase and reduce the pitch. The propeller according to the present disclosure is based on the realization that the distribution of the blade's pressure side area and suction side area in relation to a pivotal axis extending through the blade is of great importance for achieving an advantageous self-adjustment of the pitch over a wide range of propeller rpm, axial speed through the water and load. Specifically it has been found that an optimal self-adjustment of the pitch is achieved over such a wide range when the pivotal axes extending through the blades are positioned such that more than half of the suction side area and more than half of the pressure side area of each blade is arranged down-stream, in the rotational direction of the propeller, of the respective pivot axis. In other words, more than half of the suction side area and of the pressure side area is arranged between the pivot axis extending through the blade and the trailing edge of the blade.

By such an arrangement it has proven possible to achieve that the blades automatically assume an advantageous and at least close to optimal pitch for each rpm when the vessel accelerates from still standing to top speed. Since the blades are mechanically inter-connected to freely transfer the pivotal movement between the blades, the hydro-dynamical forces are free to act on the blades without any biasing means striving to rotate the blades with or against the influence of the hydro-dynamical forces. By this means the acceleration of the vessel is increased and the energy consumption is decreased at the same time as the maneuverability is enhanced and the top speed may be increased. The propeller may thus enhance the overall performance of the vessel and at the same time reduce the environmental impact of its use. The comparatively simple criteria for achieving these advantageous effects may also readily be implemented at various propeller types and designs such that the propeller may be realized with a comparatively low number of constituent parts. This in turn enhances the reliability and service life of the propeller and facilitates simple manufacturing at low cost. The propeller may further readily be designed to allow easy assembling and disassembling such that service and repair is facilitated.

According to an embodiment of said first aspect, ≤92% of the suction side area and ≤96% of the pressure side area is arranged between the trailing edge and the pivotal axis of each blade.

Each blade may be limitedly pivotal about the pivot axis between a minimum and a maximum pivot angle.

Each blade may be formed such that the minimum pivot angle corresponds to a pitch of 7 inch and the maximum pivot axis corresponds to a pitch of 27 inch.

Each blade may be fixed to or formed integral with a respective blade root.

The blades may be mechanically inter-connected by means of a gear arrangement.

The gear arrangement may then comprise first gear teeth arranged on each blade root and second gear teeth arranged on at least one interconnecting member.

The at least one interconnecting member may comprise a ring-shaped member and the second gear teeth of the ring-shaped member may mesh with the first gear teeth of all blade roots.

The at least one interconnecting member may comprise a plurality of cog wheels and the second gear teeth of each cog wheel may mesh with the first gear teeth of two mutually adjacent blade roots.

The hub may exhibit an axially extending exhaust channel for transportation of exhaust gases.

The exhaust channel may be annular and arranged concentrically around the central bore of the hub.

The hub may comprise an exhaust turbine which is fixed to the hub and arranged in the exhaust channel.

The hub may comprise a central sleeve exhibiting the central bore and a peripheral sleeve concentrically arranged with and outside the central sleeve thereby forming the exhaust channel between the central sleeve and the peripheral sleeve.

The peripheral sleeve may be connected to the central sleeve by means of helically arranged spokes which form respective turbine blades of the exhaust turbine.

The hub comprises at least two segments which are mutually fixed one after the other in the axial direction of the propeller and wherein the blades are fixed to the hub at respective recesses formed in the hub at the junction between two segments.

The number of blades may be between two and eight, preferably between three and five.

According to a second aspect, the present disclosure provides a self-adjusting variable pitch propeller for marine use which propeller comprises a central hub with an axial propeller centre line defining the rotational axis of the propeller and a plurality of blades extending radially from the hub, wherein the hub exhibits a central bore arranged to receive a rotating drive shaft, each blade is pivotally fixed to the hub and pivotal about a respective blade pivot axis which extends radially from the hub, the blades are mechanically interconnected to transfer pivotal movement of each blade to all other blades and wherein the hub exhibits an axially extending exhaust channel for transportation of exhaust gases.

According to an embodiment of the propeller of the second aspect the exhaust channel is annular and arranged concentrically around the central bore of the hub.

The hub may comprise an exhaust turbine which is fixed to the hub and arranged in the exhaust channel.

The hub may comprise a central sleeve exhibiting the central bore and a peripheral sleeve concentrically arranged with and outside the central sleeve thereby forming the exhaust channel between the central sleeve and the peripheral sleeve.

The peripheral sleeve may be connected to the central sleeve by means of helically arranged spokes which form respective turbine blades of the exhaust turbine.

According to a third aspect the present disclosure provides a self-adjusting variable pitch propeller for marine use which propeller comprises a central hub with an axial propeller centre line defining the rotational axis of the propeller and a plurality of blades extending radially from the hub, wherein the hub exhibits a central bore arranged to receive a rotating drive shaft, each blade is pivotally fixed to the hub and pivotal about a respective blade pivot axis which extends radially from the hub, the blades are mechanically interconnected to transfer pivotal movement of each blade to all other blades and wherein the hub comprises at least two segments which are mutually fixed one after the other in the axial direction of the propeller and wherein the blades are fixed to the hub at respective recesses formed in the hub at the junction between two segments.

Further objects and advantages of the self-adjusting variable pitch propeller according to the first, second and third aspects will be apparent from the following description of exemplifying embodiments and from the appended claims.

BRIEF DESCRIPTION OF THE DRAWINGS

Aspects and embodiments are now described, by way of example, with reference to the accompanying drawings, in which.

DETAILED DESCRIPTION

The aspects of the present disclosure will now be described more fully hereinafter with reference to the accompanying drawings, in which certain embodiments of the invention are shown.

These aspects may, however, be embodied in many different forms and should not be construed as limiting; rather, these embodiments are provided by way of example so that this disclosure will be thorough and complete, and to fully convey the scope of all aspects of invention to those skilled in the art. Like numbers refer to like elements throughout the description.

Figure 1:
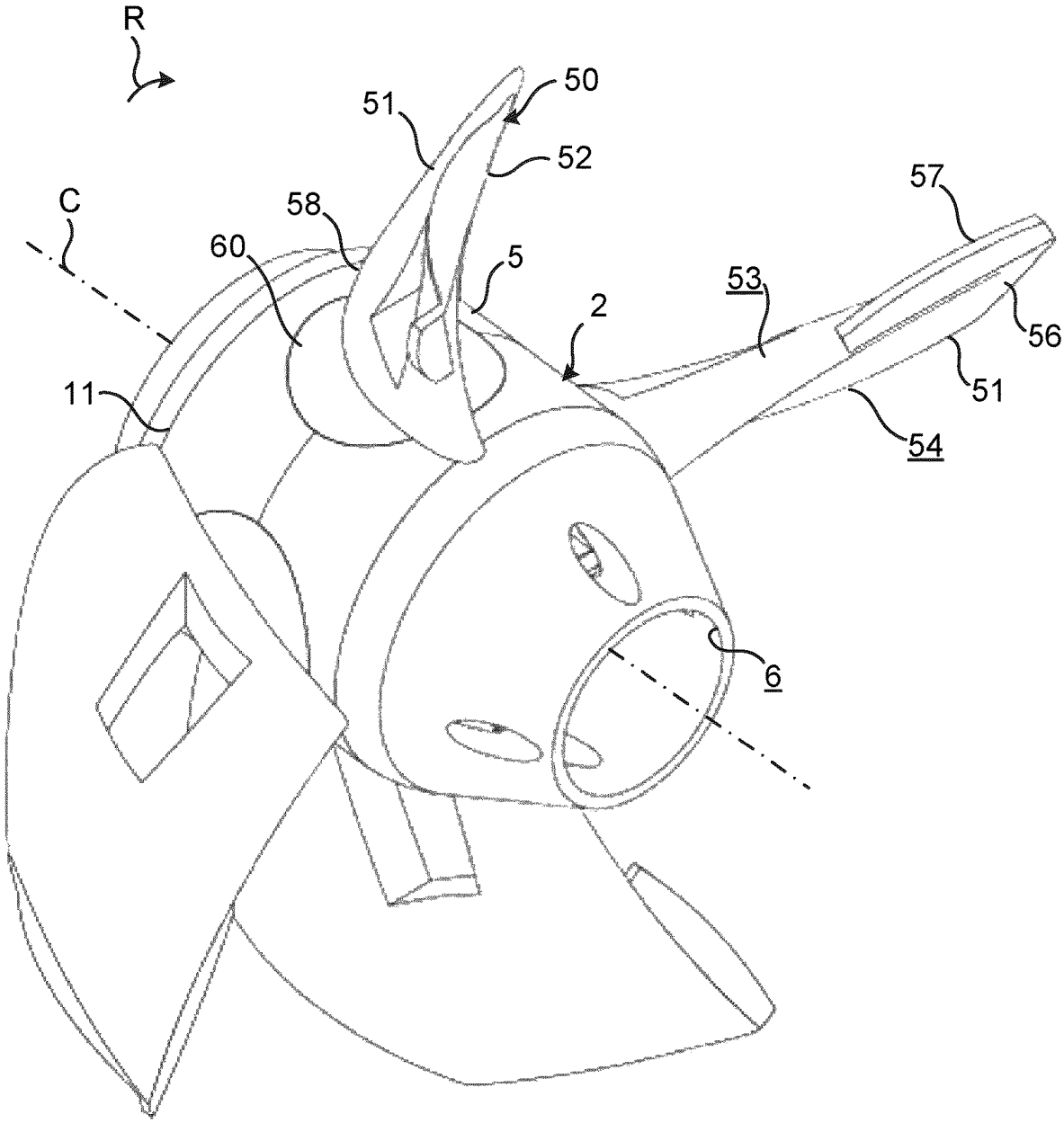
FIG. 1 is a perspective view of a self-adjusting variable pitch propeller according to one embodiment.

The self-adjusting variable pitch propeller 1 shown in FIGS. 1-6 is intended for marine use at a vessel or a boat having a power plant in the form of an inboard or outboard combustion engine. The propeller comprises a hub 10 and four blades 50 which are equally distributed about the circumference of the hub 10. In alternative, not shown embodiments, the propeller may however comprise another number of plural blades. Typically, the propeller may comprise 2-8 and preferably 3-5 blades. The hub 10 is arranged to be fixed to an output shaft S (FIG. 5) of the engine and has an axial propeller centre line C which defines the rotational axis of the propeller 1. During forward drive of the vessel, the propeller 1 rotates about the centre line C in the clockwise rotational direction R as seen in FIG. 1.

Each blade 50 is fixed to a blade root 60 and extends radially, with respect to the axial centre line C, from the hub 10 and is pivotally fixed to the hub such that each blade 50 is pivotal about a respective pivot axis P (FIG. 2) which extends radially through the blade 50 and the blade root 60 with respect to the centre line C. The blades 50 are essentially mutually identical and the following description of one blade 50 applies equally to all four blades 50. Each blade 50 exhibits a leading edge 51 and a trailing edge 52. The leading edge 51 faces in the rotational direction R during forward drive of the vessel. Each blade 50 further exhibits a suction side 53 exhibiting a suction side area and a pressure side 54 exhibiting a pressure side area, both of which extends between the leading edge 51 and the trailing edge 52. During forward drive, the suction side 53 is arranged generally in front of the pressure side 54 with respect to the forward movement of the vessel. The blade 50 exhibits a three-dimensional double curved geometry in a manner such that the suction side 53 is convex and the pressure side 54 is concave. This results in that the suction side 53 area is larger than the pressure side 54 area. In the shown example the blade 50 and the blade root are formed integrally as a single piece component. The blade and blade root may however also be formed as different components which are fixedly connected.

Each blade further comprises a bladelet 55 or vortex reducer which is arranged at the blade tip 56 being positioned at the radially outer end of the blade 50. The bladelet 55 is formed as a protrusion or bead which protrudes from the blade tip 56 edge towards the suction side 53 and reduces water flow from the suction side to the pressure side 54, over the blade tip to thereby reduce cavitation at the blade tip 56. The length of the bladelet 55 is preferably approx. 5-15% of the total radial length of the blade 50. The blade 50 further comprises a blade diffuser 57 or separation delayer which is arranged at the trailing edge 52 and extends from the blade tip 56 inwardly, approx. half the way towards the hub 10. The blade diffuser 57 comprises a portion of the blade in the region adjacent the trailing edge, which portion is bent or curved towards the suction side 53. The length of the blade diffuser in the rotational direction R of the propeller is approx. 10-15% of the distance between the leading 51 and trailing 52 edge at the blade diffuser. The blade diffuser 57 reduces the water resistance experienced by the propeller to thereby increase the efficiency and reduce fuel consumption. The blade further exhibits a through opening 58 which is arranged at the radially inner half of the blade. The area of the through opening 58 constitutes approx. 30% of the radially inner half of the suction side 53 area. The through opening 58 results in that the active suction side area and pressure side area is moved radially outwards towards the peripheral portion of the blade. Since this portion exhibits a higher rotational speed than the radial inner portion of the blade, the through opening 58 increases the efficiency and, in particular, increases acceleration and starting torque.

Figure 4:
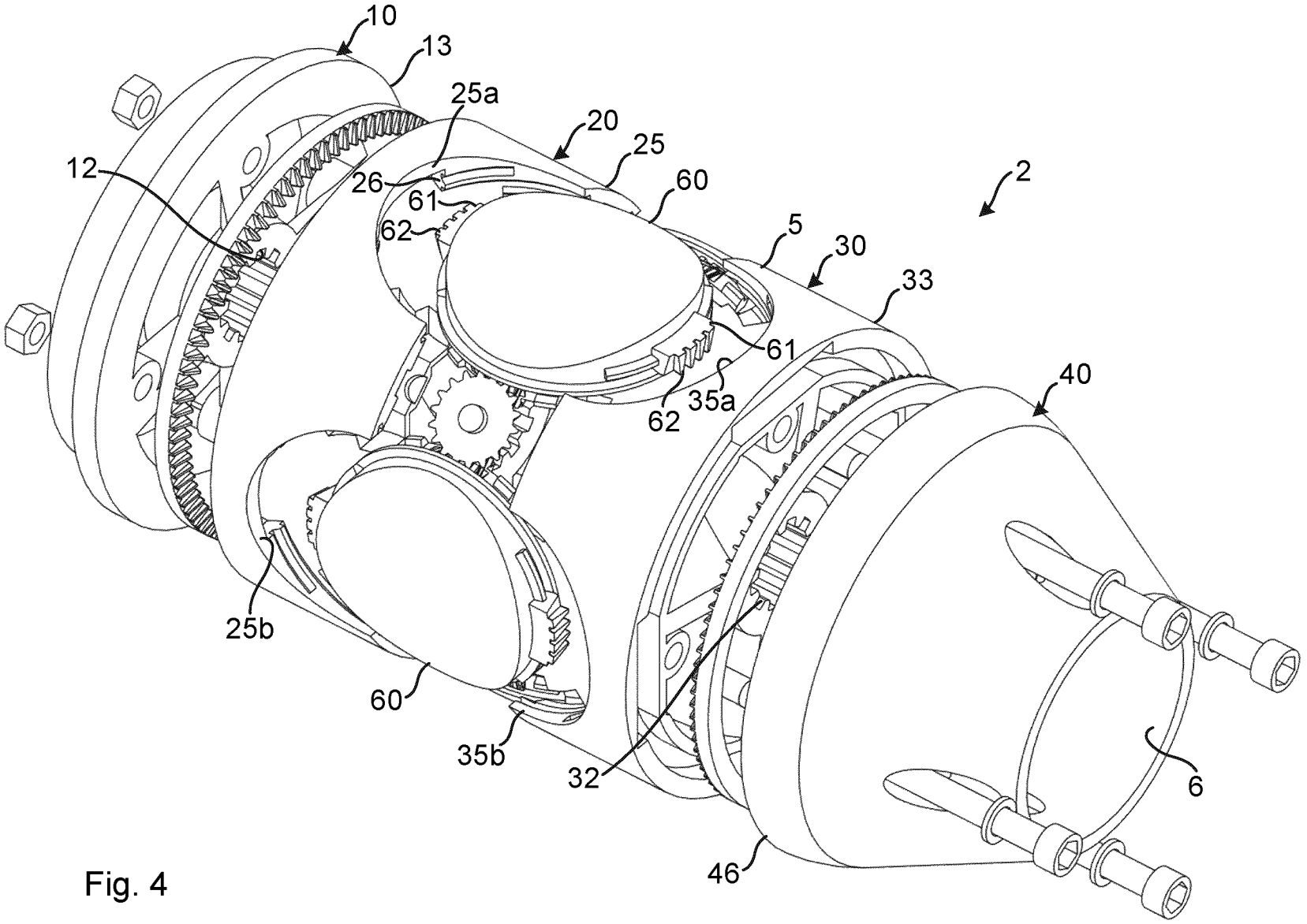
FIG. 4 is an exploded view in perspective illustrating the propeller shown in FIG. 1 with some parts removed.
Figure 5:
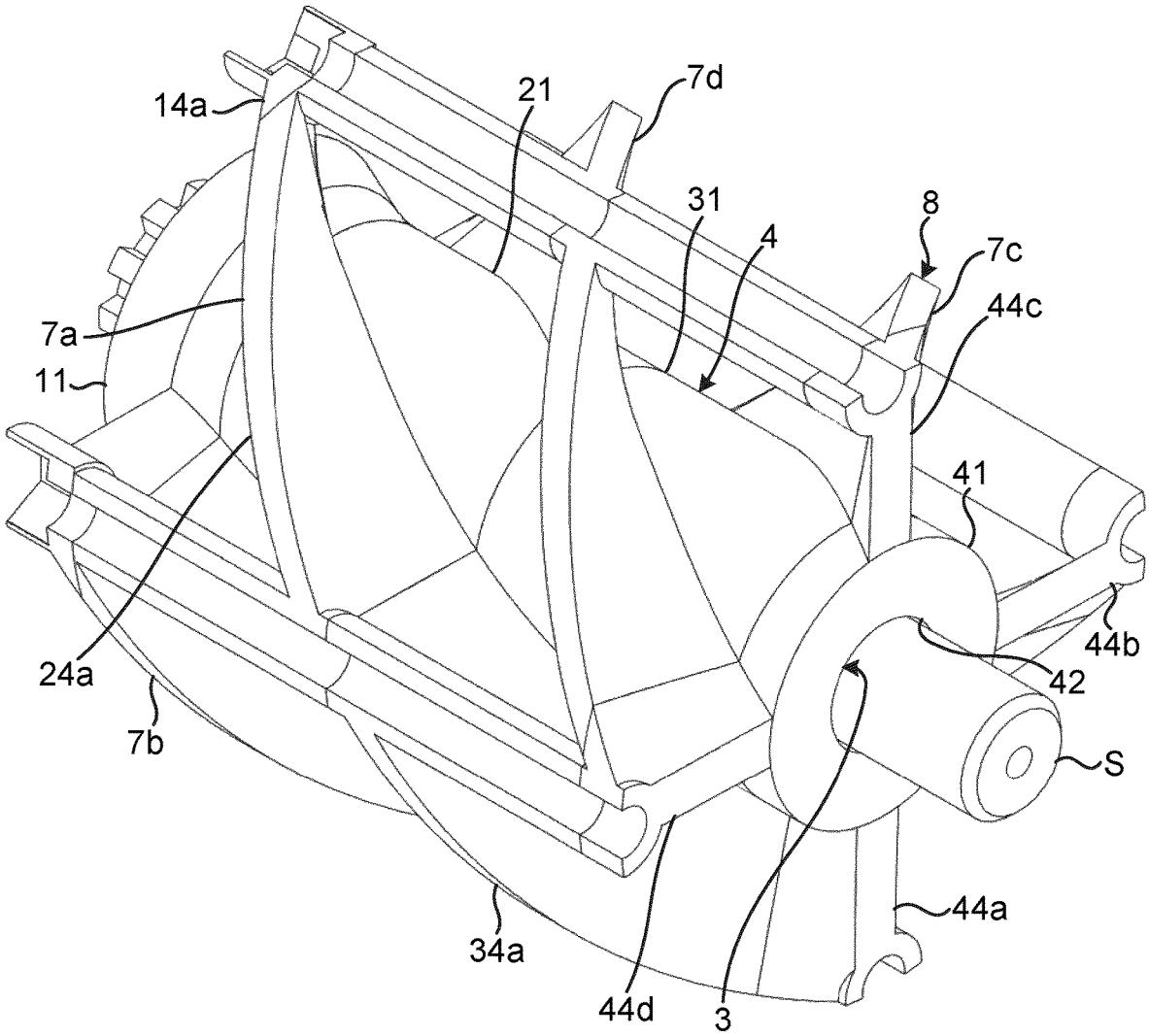
FIG. 5. Is a perspective view illustrating some internal components of the propeller shown in FIG. 1.

The hub 2 will now be explained in further detail with reference mainly to FIGS. 4 and 5. FIG. 4 is an exploded view of the hub 2 and FIG. 5 illustrates the hub 2 assembled but with some outer parts removed. The hub 2 comprises four axial segments 10, 20, 30, 40 which are arranged one after the other in the axial direction of the centre line C. The segments comprise a front segment 10, a first intermediate segment 20, a second intermediate section 30 and a rear segment 40. The segments are fixedly connected to each other by means of axially extending fastening screws and bots as shown in FIG. 4. Each section comprises a tubular inner sleeve portion 11, 21, 31, 41 which exhibits a central splined bore portion 12, 32, 42. The inner sleeve portions together form a central sleeve 4 of the hub 2 and the bore portions together form a central splined bore 3 of the hub 2 which bore 3 receives the rotating drive shaft S of the engine.

Each segment 10, 20, 30, 40 further comprises an outer sleeve portion 13, 23, 33, 43 which is arranged concentrically with and outside the respective inner sleeve portion 11, 21, 31, 41 and which together form a peripheral sleeve 5 of the hub 2. By this means an annular space is formed between peripheral sleeve 5 and the central sleeve 4, which space constitutes an exhaust channel 6 extending axially through the hub 2. When the propeller 1 is fixed on the output shaft S of the engine, the front end of the exhaust channel 6, which front end is formed by the front segment 10 is in communication with an exhaust outlet of the engine such that exhaust gases from the engine passes through the exhaust channel 6 of the hub 2.

At each segment 10, 20, 30, 40, the inner sleeve portion 11, 21, 31, 41 is connected to the respective outer sleeve portion 13, 23, 33, 43 by means of spoke members 14*a*, 24*a*, 34*a*, 44*a-d*. In the shown example each segment 10, 20, 30, 40 comprises four helical spoke members as best illustrated in FIG. 5 by the four helical spoke members 44*a-d* of the rear segment 40. Each spoke member forms an axial section of a turbine blade 7*a-d*, such that when the segments are assembled, four turbine blades 7*a-d* are formed in the exhaust channel. In FIG. 5, this is best represented by the spoke members 14*a*, 24*a*, 34*a*, 44*a* which together form the turbine blade 7*a*. In this manner, the four turbine blades 7*a-d* together form part of a turbine 8. Upon rotation of the propeller 1, the turbine 8 greatly decreases the resistance for the exhaust gases to leave the engine, thereby increasing the efficiency of the engine, increasing acceleration and reducing the fuel consumption.

Figure 6:
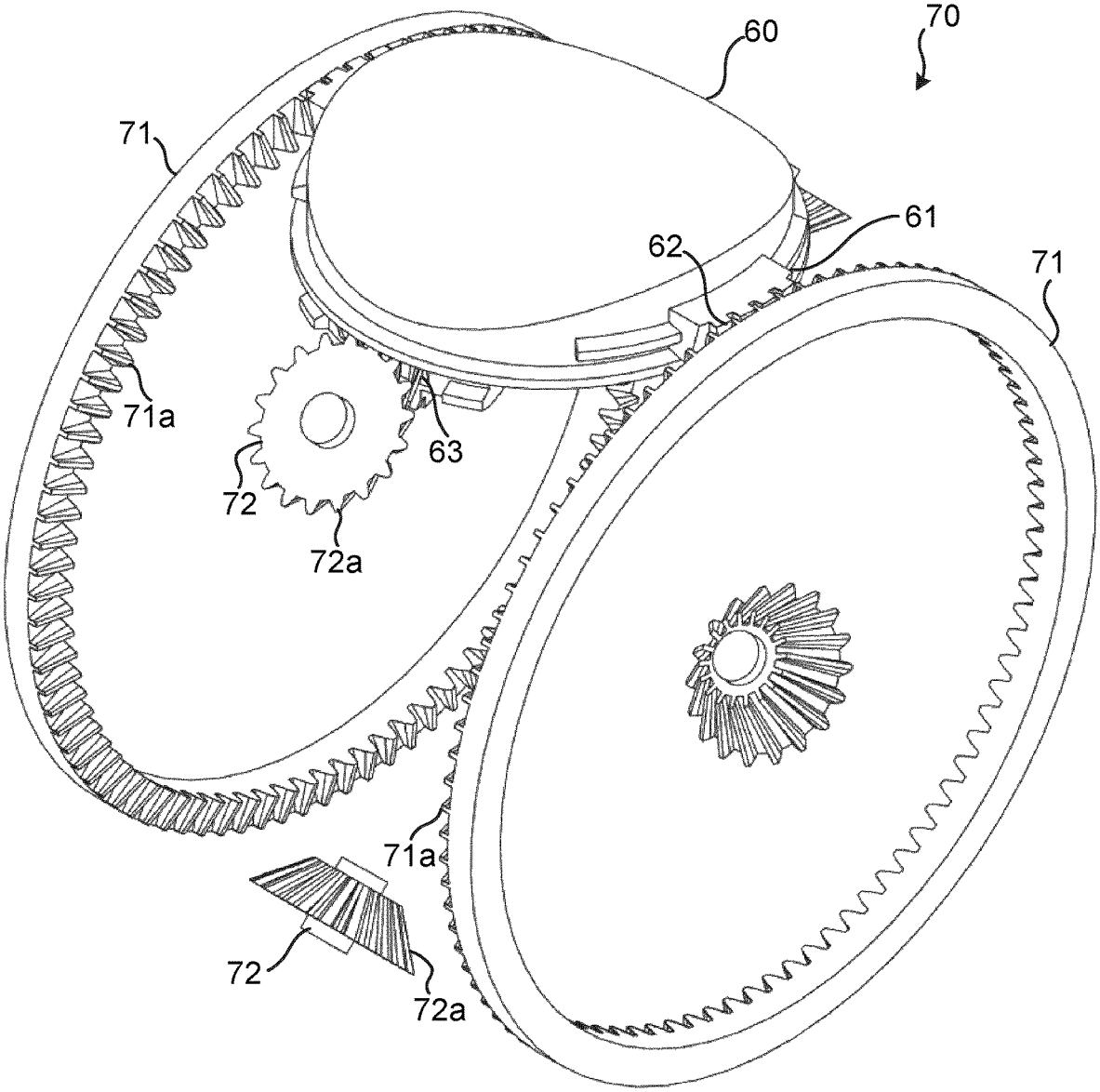
FIG. 6 is a perspective view showing illustrating other components of the propeller shown in FIG. 1.

The hub 1 further comprises a gear arrangement 60 which is best seen in FIGS. 4 and 6. In these figures the blade has been removed for increased visibility such that only the blade root 60 is shown. Further, in FIG. 6 only one of the four blade roots is shown. The blade root 60 is journaled to the outer sleeve 5 of the hub 2. For this purpose, the first 20 and second 30 intermediate sections each exhibits four semi-circular openings 25*a-b*, 35*a-b* arranged through the respective outer sleeve portion 23, 33, and mutually facing each other in pairs 25*a*-35*a* and 25*b*-35*b*. Each blade root 60 has a cylindrical portion, the diameter of which corresponds to the diameter of cylindrical opening defined by each pair 25*a*-35*a*, 25*b*-35*b* of semi-circular openings, such that the blade root 60 and the blade 50 may pivot about the pivot axis P (FIG. 2) relative to the hub 2. Each blade root 60 comprises two opposing radially protruding stop members 61 each of which is received in a corresponding respective recess 26 formed in the outer sleeve portions 23, 33 with a clearance. By this means the pivotal movement in both pivotal directions of the blade 50 and blade root 60 is limited to a maximum pivotal angle defined by the clearance. Preferably the clearance should be selected such as to allow pivoting of the blade 50 between a minimum pitch of 7 inch and a maximum pitch of 27 inch. In the shown example this corresponds to a maximum pivotal angle of approx. 36°.

The gear arrangement comprises interconnecting members 71, 72 arranged to mechanically interconnect the blade roots 60 for synchronising the pivotal movement of the blades 50. In the shown example, the gear arrangement comprises two different types of interconnecting members 71, 72.

A first type comprises two ring-shaped members 71 each exhibiting primary second gear teeth 71*a* which mesh with primary first gear teeth 62 arranged on the stop members 61 of all four blade roots 62 (only one shown in FIG. 6).

A second type of interconnecting members comprises four bevelled cog wheels 72 with secondary second gear teeth 72*a* which meshes with secondary first gear teeth 63 arranged at the blade root 60. The secondary second gear teeth 72 of each cog wheel 72 meshes with the secondary first gear teeth 63 of two neighbouring or adjacent blade roots.

Both the first 71 and the second 72 type of interconnecting members assures that all four blades 60 are interconnected and synchronized such that all blades assume the same pitch at all instances. It should be noted that neither the gear arrangement 60 as a whole or the first 71 or second 72 type of interconnecting members comprise any biasing means striving to rotate the blades in a certain direction or towards a certain rotational position. In the shown example, the propeller is provided with both the first and the second type of interconnecting members. In many cases however it suffices to provide the propeller with either the first type or the second type. In cases where the first type of interconnecting members is used the gear arrangement may comprise only one such interconnecting member 71. However, it may be preferable to arrange two such interconnecting members 71 for symmetry reasons and for avoiding skewing of the blade root and the interconnecting member caused by non-symmetrical load. The type and number of interconnecting members may be selected depending on i.a. the power output of the engine, the size of the propeller and the hub and the type of vessel to be propelled by the propeller.

Figure 2:
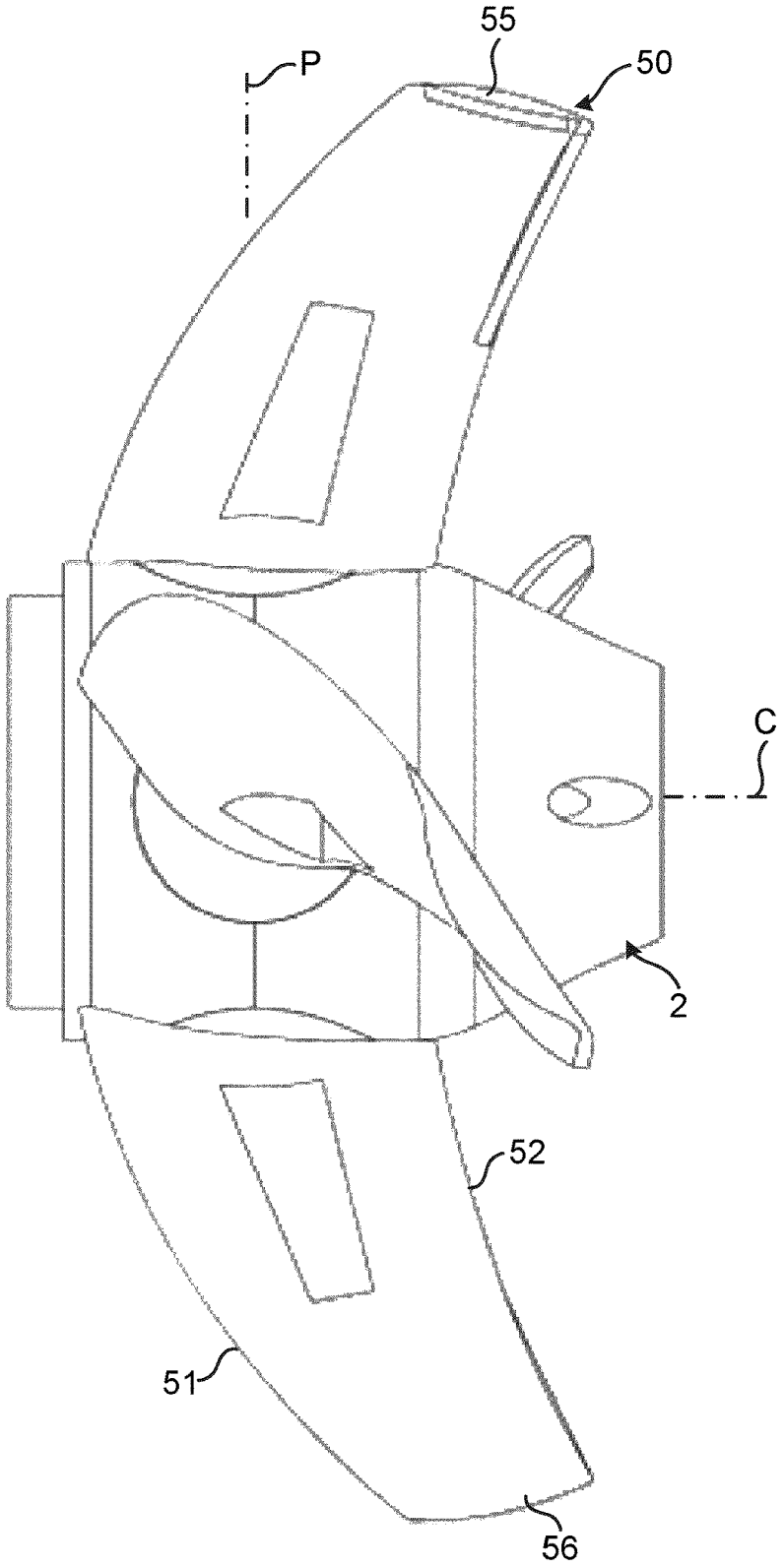
FIG. 2 is a side view of the propeller shown in FIG. 1.
Figure 7:
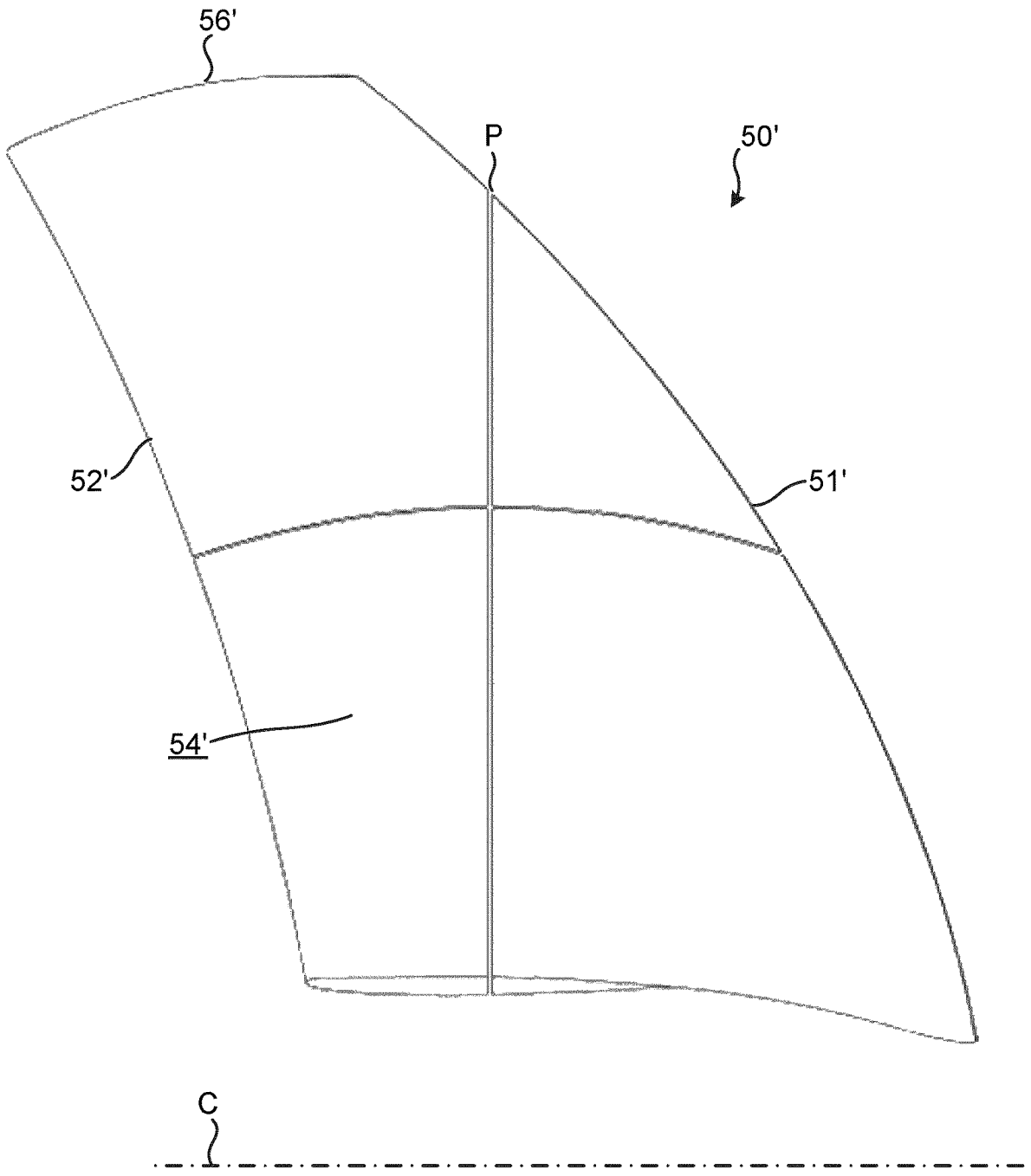
FIGS. 7 and 8 are plane views illustrating the suction side and the pressure side respectively of a blade which may be comprised in a propeller according to a second embodiment.
Figure 8:
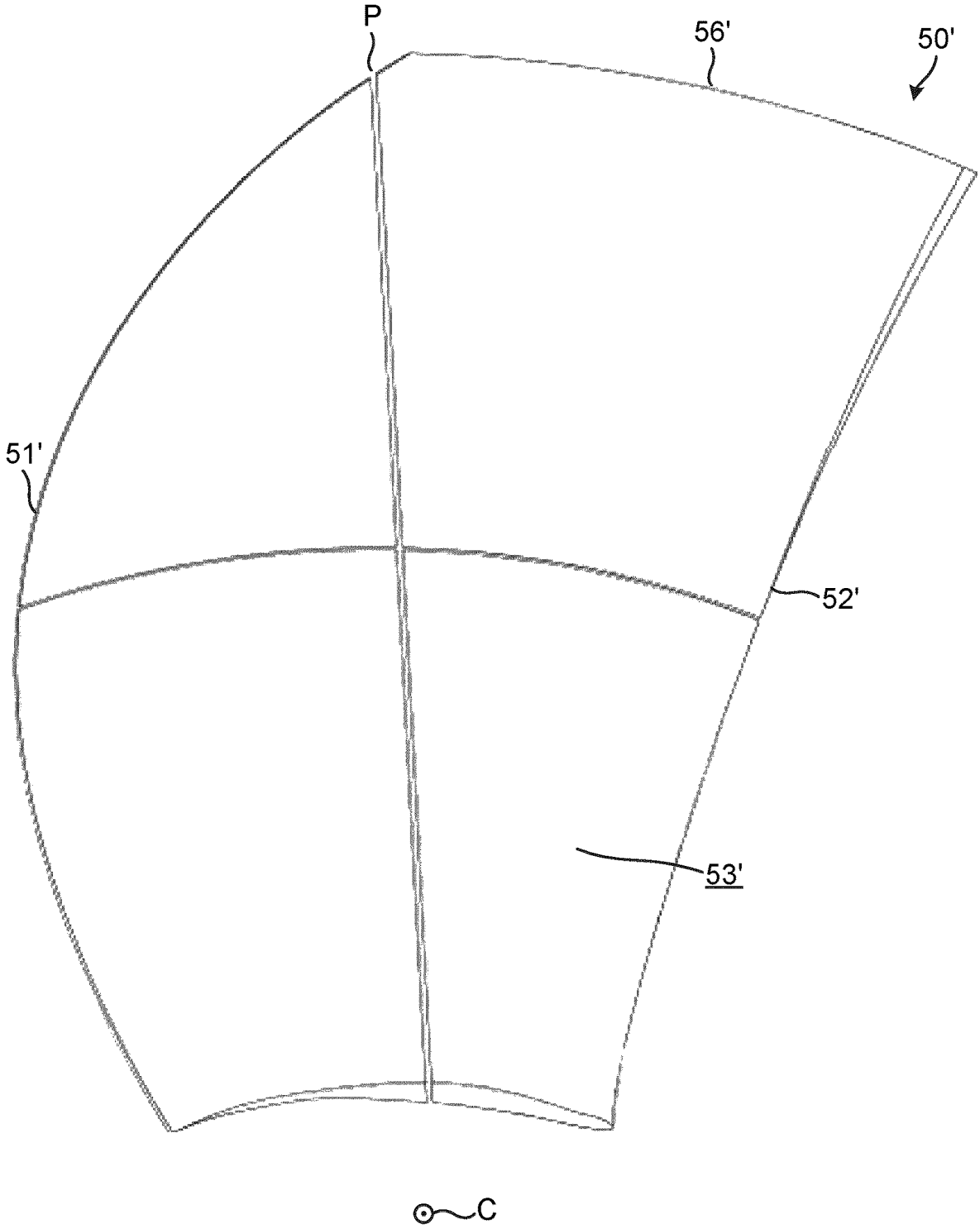

As best illustrated in FIGS. 7 and 8 the suction side area and the pressure side area of the blades are arranged with in a specific manner with respect to the pivot axis P of the blades. FIG. 7 is a side view corresponding to the view in FIG. 2 illustrating an exemplifying blade 50' (without the blade root) according to a second embodiment. FIG. 7 shows the pressure side of the blade 50' FIG. 8 is a plan view from the front of the propeller showing the suction side of the propeller 50' shown in FIG. 7. In both FIGS. 7 and 8, the direction of the propeller centre line C has been schematically indicated for reference purposes.

Figure 3:
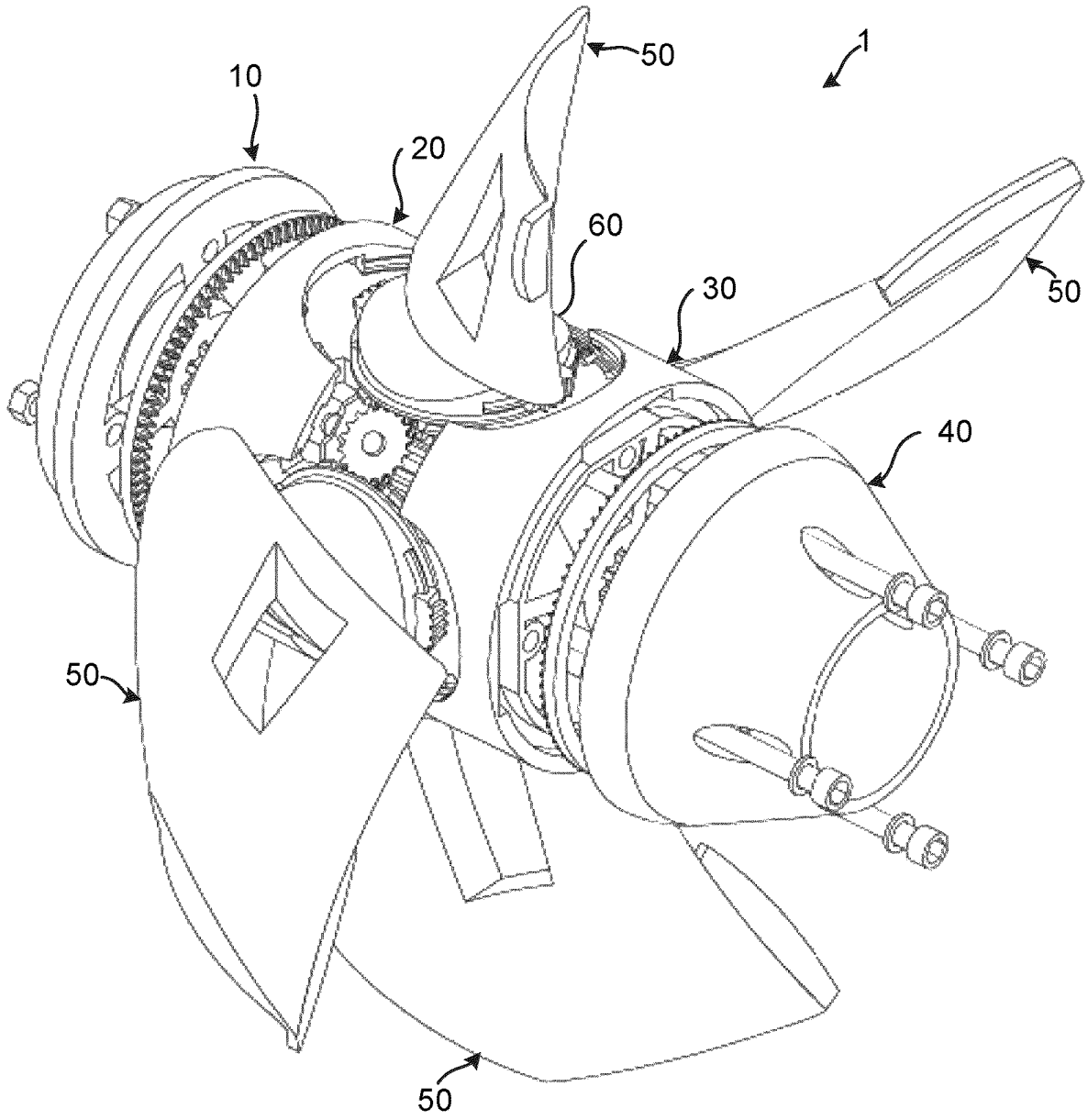
FIG. 3 is an exploded view in perspective of the propeller shown in FIG. 1.

As in the example shown in FIGS. 1-3, the blade comprises a leading edge 51', a trailing edge 52' and a blade tip 56'. The pressure side 54' shown in FIG. 7 and the suction side 53' shown in FIG. 8 both extend between the leading edge 51', the trailing edge 52', the blade tip 56' and the not shown blade root arranged proximal to the centre line C. The blade 50' is pivotal about the pivot axis P as described above with reference to FIGS. 1-6. Both the pressure side 54' and the suction side 53' surfaces are double curved in such a manner that the suction side area is somewhat greater than the pressure side area. The pivot axis P extends through the blade 50' and is arranged such that a majority i.e. more than 50% of both the suction side area 53' and the pressure side area 54' is arranged at a trailing portion of the blade 50' i.e. between the pivot axis P and the trailing edge 52'. In the shown example approx. 54.8% of the suction side area and 57.5% of the pressure side area is arranged between the pivot axis P and the trailing edge 52'. It has proven especially advantageous if more than half and up to 92% of the suction side area and more than half and up to 96% of the pressure side area is arranged between the pivot axis P and the trailing edge 52'.

With such arrangements of the suction side and pressure side areas in relation to the pivot axis and the trailing edge it has been found that the blades automatically will assume an optional or at least advantageous pitch over the entire rpm interval for the propeller and that such advantageous automatic adjustment of the pitch occurs irrespective of the vessel's speed through the water, the torque applied to the propeller and within a large interval of varying diameters of the propeller. By achieving such advantageous automatic pitch adjustment, several advantages in the form of increased acceleration, higher top speed, lower energy consumption and better maneuverability of the vessel are gained. With the design of the propeller disclosed herein these advantages are readily achieved in a simple manner grace to the comparatively simple construction of the propeller comprising inly a low number of constituent components. The design and especially the modular construction comprising axially aligned segments of the hub also allows for easy assembling and disassembling of the propeller and thereby that damaged components such as the blades readily may be replaced.

The aspects of the present disclosure have mainly been described above with reference to a few embodiments and examples thereof. However, as is readily appreciated by a person skilled in the art, other embodiments than the ones disclosed above are equally possible within the scope of the invention, as defined by the appended patent claims.

The invention claimed is:

1. A self-adjusting variable pitch propeller for marine use, comprising a central hub with an axial propeller centre line defining a rotational axis of the propeller and a plurality of blades extending radially from the hub, wherein the hub exhibits a central bore arranged to receive a rotating drive shaft, each blade is pivotally fixed to the hub and pivotal about a respective blade pivot axis which extends radially from the hub through the respective blade, each blade exhibits a leading edge, a trailing edge, a pressure side exhibiting a pressure side area and a suction side exhibiting a suction side area, the blades are mechanically interconnected to freely transfer pivotal movement of each blade to all other blades and wherein the pivotal axis of each blade is positioned such that >50% of the suction side area and of the pressure side area is arranged between the trailing edge and the pivotal axis of the respective blade.

2. A self-adjusting variable pitch propeller according to claim 1, wherein ≤92% of the suction side area and ≤96% of the pressure side area is arranged between the trailing edge and the pivotal axis of each blade.

3. A self-adjusting variable pitch propeller according to claim 1, wherein each blade is limitedly pivotal about the pivot axis between a minimum and a maximum pivot angle.

4. A self-adjusting variable pitch propeller according to claim 3, wherein each blade is formed such that the minimum pivot angle corresponds to a pitch of 7 inch and the maximum pivot angle corresponds to a pitch of 27 inch.

5. A variable pitch propeller according to claim 1, wherein each blade is fixed to or formed integral with a respective blade root.

6. A variable pitch propeller according to claim 1, wherein the blades are mechanically inter-connected by means of a gear arrangement.

7. A variable pitch propeller according to claim 6, wherein the gear arrangement comprises first gear teeth arranged a respective blade root of each blade and second gear teeth arranged on at least one interconnecting member.

8. A variable pitch propeller according to claim 7, wherein the at least one interconnecting member comprises a ring-shaped member and wherein the second gear teeth of the ring-shaped member mesh with the first gear teeth of all blade roots.

9. A variable pitch propeller according to claim 7, wherein the at least one interconnecting member comprises a plurality of cog wheels and wherein the second gear teeth of each cog wheel mesh with the first gear teeth of two mutually adjacent blade roots.

10. A variable pitch propeller according to claim 1, wherein the hub exhibits an axially extending exhaust channel for transportation of exhaust gases.

11. A variable pitch propeller according to claim 10, wherein the exhaust channel (6) is annular and arranged concentrically around the central bore of the hub.

12. A variable pitch propeller according to claim 10, wherein the hub comprises an exhaust turbine which is fixed to the hub and arranged in the exhaust channel.

13. A variable pitch propeller according to claim 10, wherein the hub comprises a central sleeve exhibiting the central bore and a peripheral sleeve concentrically arranged with and outside the central sleeve thereby forming the exhaust channel between the central sleeve and the peripheral sleeve.

14. A variable pitch propeller according to claim 13, wherein the peripheral sleeve is connected to the central sleeve by means of helically arranged spokes which form respective turbine blades of an exhaust turbine.

15. A variable pitch propeller according to claim 1, wherein the hub-comprises at least two segments which are mutually fixed one after the other in the axial direction of the propeller and wherein the blades are fixed to the hub at respective recesses formed in the hub at the junction between two segments.

16. A variable pitch propeller according to claim 1, wherein the number of blades is between two and eight.

* * * * *